US006698099B2

(12) United States Patent
Ronan et al.

(10) Patent No.: US 6,698,099 B2
(45) Date of Patent: Mar. 2, 2004

(54) CONVERTIBLE KNIFE

(75) Inventors: John S. Ronan, Temecula, CA (US); Richard A. Kluender, Temecula, CA (US)

(73) Assignee: Ronan Tools, Inc., San Jacinto, CA (US)

( * ) Notice: Subject to any disclaimer, the term of this patent is extended or adjusted under 35 U.S.C. 154(b) by 173 days.

(21) Appl. No.: 10/021,479

(22) Filed: Nov. 30, 2001

(65) Prior Publication Data

US 2003/0101590 A1 Jun. 5, 2003

(51) Int. Cl.[7] ..... B25F 1/04
(52) U.S. Cl. ..... 30/122; 30/146; 30/254
(58) Field of Search ..... 30/146, 254, 122

(56) References Cited

U.S. PATENT DOCUMENTS

| | | | | | |
|---|---|---|---|---|---|
| 2,674,796 | A | * | 4/1954 | Herold | 30/262 |
| 4,809,433 | A | * | 3/1989 | Maxwell et al. | 30/254 |
| 5,255,438 | A | * | 10/1993 | Morgan | 30/254 |
| 5,379,521 | A | * | 1/1995 | Lynders | 30/233 |
| 5,625,951 | A | * | 5/1997 | Hamlin | 30/146 |

* cited by examiner

*Primary Examiner*—Allan N. Shoap
*Assistant Examiner*—Phong Nguyen
(74) *Attorney, Agent, or Firm*—Loyal McKinley Hanson

(57) ABSTRACT

A convertible knife assembly includes a knife and a conversion piece. The knife includes a blade with a handle end portion, a tip, a cutting edge intermediate the handle end an the tip, and a spine opposite the cutting edge. The conversion piece has a spine-opposing portion and a handle portion such that the conversion piece is adapted to be mounted on the knife pivotally with the spine-opposing portion opposing the spine of the blade and the handle portion opposing the handle of the knife. The action of a user squeezing the handle portion of the conversion piece and handle of the knife toward each other causes the spine-opposing portion of the conversion piece and the spine of the blade to move toward each other in order to bear against an object the user positions between the spine-opposing portion of the conversion piece and the spine of the blade. In one embodiment, the spine of the blade includes a sharpened portion that forms a secondary cutting edge, and the spine-opposing portion of the conversion piece forms an anvil facing the secondary cutting edge in order to thereby enable blade-and-anvil cutting of the object. A second embodiment enables shears-type cutting of the object, and a third embodiment enables crimping of the object.

5 Claims, 5 Drawing Sheets

CONVERTIBLE KNIFE

BACKGROUND OF THE INVENTION

1. Technical Field

This invention relates generally to knives, and more particularly to a convertible knife that can be used as a conventional fixed-blade knife and as a blade-and-anvil cutters.

2. Description of Related Art

A conventional fixed-blade knife is a cutting tool having a blade and a handle attached to the blade. The blade has an edge (a cutting edge) that extends from the handle end of the blade (the proximal end portion) toward the tip of the blade (the distal end portion), and a spine (the top of the blade) opposite the cutting edge that also extends from the handle end of the blade toward the tip of the blade. The spine of the blade is typically somewhat broad (at least near the handle the end) so that a user can push against it with his thumb in order to facilitate cutting with the edge of the blade. Hunting knives and kitchen knives are good examples.

Whether in the field, in the kitchen, or elsewhere, some cuts are better made with a blade-and-anvil type of cutters (i.e., a cutting tool having a blade that closes and cuts against an anvil). The blade-and-anvil cutters in U.S. Pat. Nos. D398499, D434955, D422463, and D427036 provide good examples. But, a second tool is required and so it is desirable to have a better way to accomplish these two different types of cutting.

SUMMARY OF THE INVENTION

This invention addresses the concerns outlined above by providing a convertible knife that can be used for both types of cutting. The convertible knife includes a knife member and a companion conversion member that locks onto the knife member when desired. Preferably, at least a portion of the spine of the knife is sharpened to provide a secondary cutting edge, and the conversion member locks onto the knife member pivotally to provide an anvil member that works in opposition to the secondary cutting edge. Thus, the user can quickly convert between knife stye cutting and blade-and-anvil cutting by adding or removing the conversion member.

To paraphrase some of the more precise language appearing in the claims, a convertible knife assembly constructed according to the invention includes a knife and a conversion piece. The knife has a handle and a blade. The blade includes a proximal end portion attached to the handle, a distal end portion, a cutting edge intermediate the proximal end portion and the distal end portion, and a spine intermediate the proximal and distal end portions that is disposed opposite the cutting edge. The knife may be similar in many respects to existing fixed-blade knives.

The conversion piece has a spine-opposing portion and a handle portion. It is adapted to be mounted on the knife pivotally with the spine-opposing portion opposing the spine of the blade and the handle portion opposing the handle of the knife. The action of a user squeezing the handle portion of the conversion piece and handle of the knife toward each other causes the spine-opposing portion of the conversion piece and the spine of the blade to move toward each other in order to bear against an object the user positions between the spine-opposing portion and the spine of the blade.

In one embodiment, the spine of the blade includes a sharpened portion that forms a secondary cutting edge, and the spine-opposing portion of the conversion piece forms an anvil facing the secondary cutting edge. That arrangement enables blade-and-anvil cutting of the object. In another embodiment, the spine-opposing portion of the conversion piece forms a conversion piece cutting edge opposing the secondary cutting edge of the blade in order to enable shears-type cutting of the object. In yet another embodiment, the spine-opposing portion of the conversion piece forms a dull edge facing the spine of the blade in order to enable crimping of the object.

Preferably, the conversion piece includes a mid portion that defines a channel into which the blade of the knife fits. The mid portion includes a pin extending across the channel that defines a pivot point, and the blade of the knife defines a recess adapted to engage the pin. A spring-loaded hook assembly on the conversion piece engages a protrusion on the blade as the blade is inserted into the channel, so that the hook assembly spring biases the blade toward the pin as the pin seats in the recess.

Thus, the invention provides a convertible knife that the user can readily disassembly for independent use of the knife and for cleaning purposes. The following illustrative drawings and detailed description make the foregoing and other objects, features, and advantages of the invention more apparent.

DESCRIPTION OF THE PREFERRED EMBODIMENTS

Figure 1:
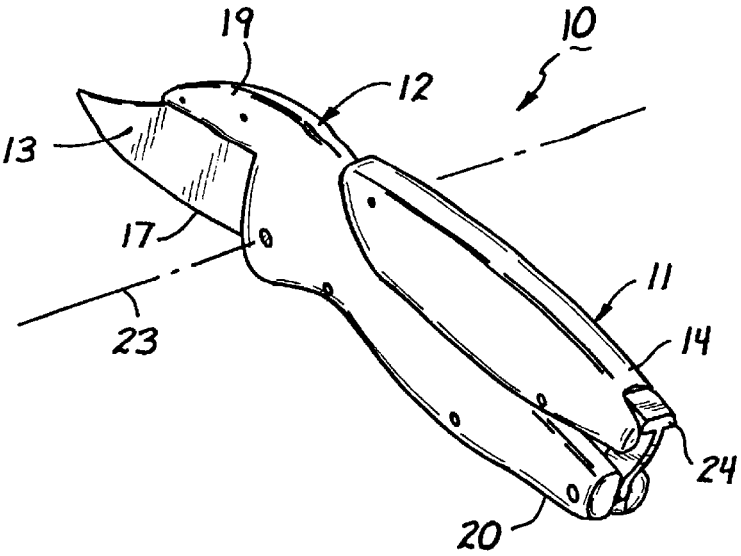
FIG. 1 of the drawings is a perspective view of a convertible knife constructed according to the invention, shown in a closed configuration with the blade closed against the anvil.
Figure 2:
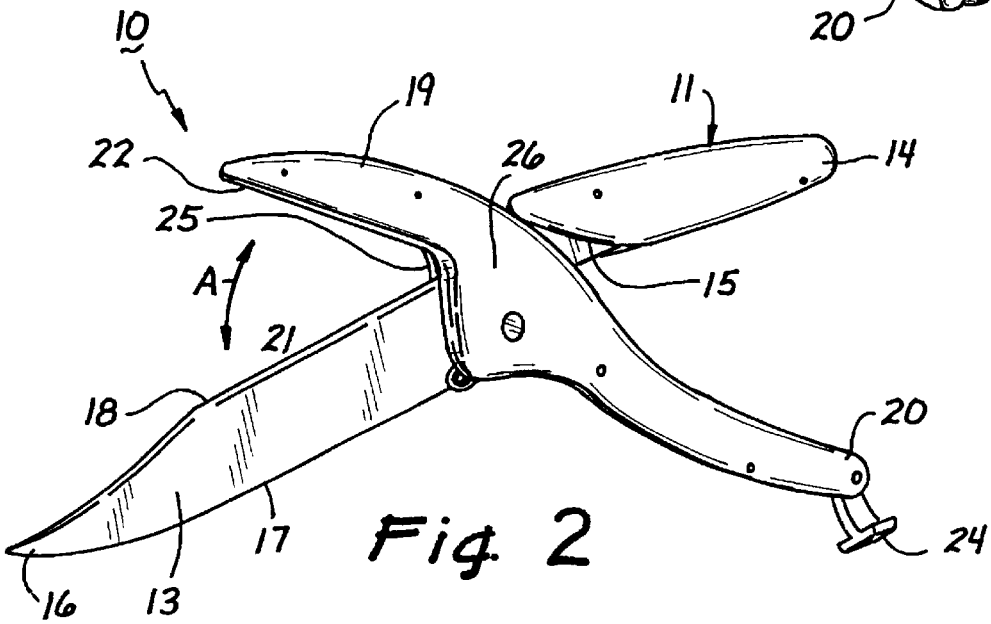
FIG. 2 is another perspective view of the convertible knife shown in an open configuration, with the blade spaced apart from the anvil.
Figure 3:
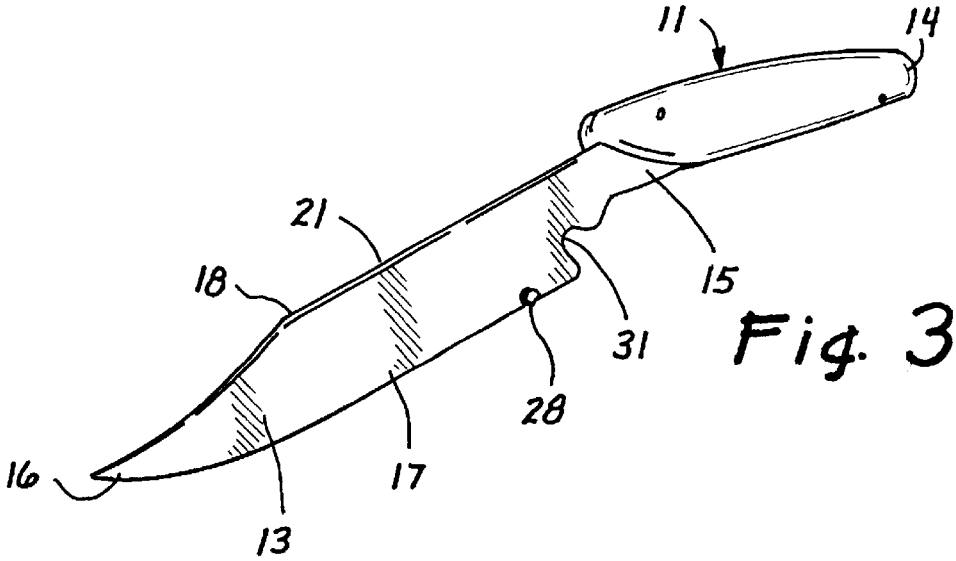
FIG. 3 is a perspective view of just the knife of the convertible knife.
Figure 5:
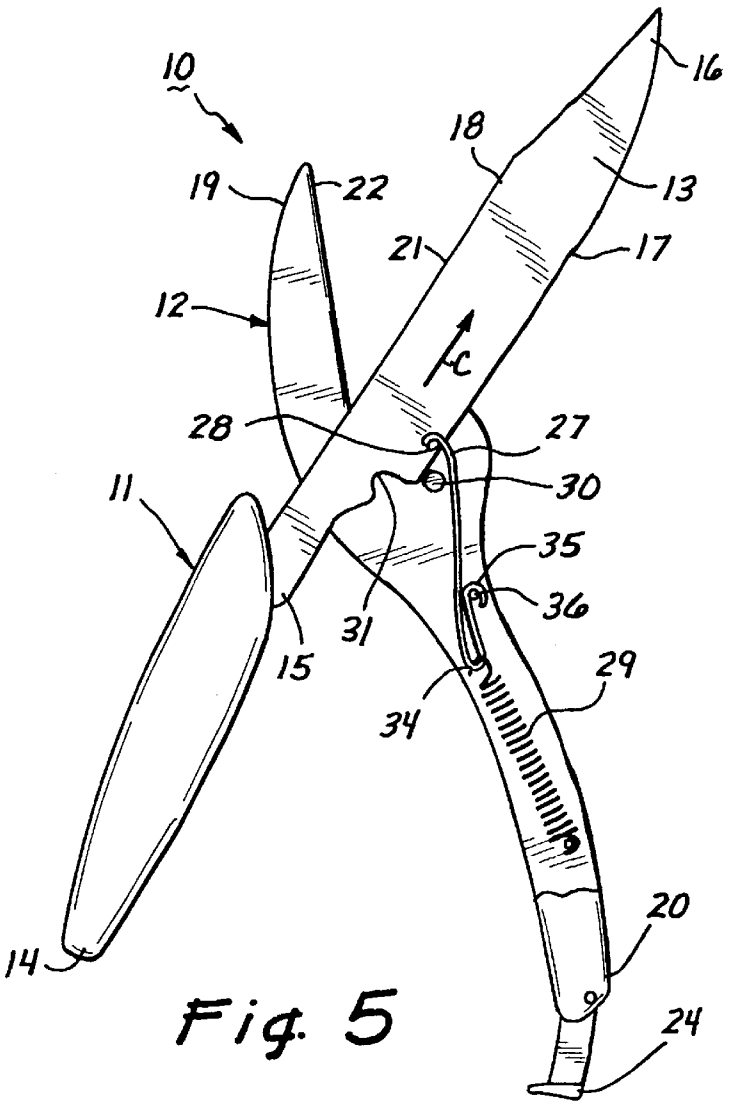
FIG. 5 is a plan view that shows engagement of the recess on the blade of the knife by the hook component.

FIGS. 1–9 of the drawings show various aspects of a convertible knife assembly 10 constructed according to the invention. Generally, the convertible knife assembly 10 includes a knife 11 (FIGS. 1–7) and a conversion piece 12 (FIGS. 1–6 and 9). Those two components assemble together to form the convertible knife assembly 10.

Focusing first on the nomenclature used for this description and the claims, the knife 11 has a blade 13 (FIGS. 1–9) and a handle 14. The blade 13 includes a handle end 15 (i.e., a proximal end portion) that is attached to the handle 14, a tip 16 (i.e., a distal end portion) opposite the handle end 15, a cutting edge 17 intermediate the handle end 15 and the tip 16, and a spine 18 intermediate the handle end 14 and the tip 16 that is disposed opposite the cutting edge 17.

The knife 11 may be similar in many respects to existing fixed-blade knives, with the spine 18 sometimes being referred to as the top of the blade 13. The blade 13 of the illustrated knife 11 is about 5.5 inches to 6.0 inches long and is composed of steel, while the handle 14 is about 4.0 inches long and composed of plastic. Of course, those details can vary significantly within the scope of the claims and the inventive concepts disclosed.

The conversion piece 12 (e.g., a 7.5 inch long plastic piece) includes a spine-opposing portion 19 and a handle portion 20. It is adapted to be mounted on the knife 13 pivotally with the spine-opposing portion 19 opposing the spine 18 of the blade 13 and the handle portion 20 opposing the handle 14 of the knife 13. The action of a user squeezing the handle portion 20 of the conversion piece 12 and handle 14 of the knife 13 toward each other causes the spine-opposing portion 19 of the conversion piece 12 and the spine 18 of the blade 13 to move toward each other as depicted by an arrow A in FIG. 2. That action results in the spine-opposing portion 19 and the spine 18 bearing against an object the user positions between the spine-opposing portion 19 and the spine 18 of the blade 13.

For blade-and-anvil cutting purposes, at least a portion of the spine 18 of the blade 13 (e.g., about two inches long) is sharpened to form a secondary cutting edge 21 (FIGS. 2–7 and 9). In addition, the spine-opposing portion 19 has a shape that forms an anvil facing the secondary cutting edge 21. It forms an anvil in the sense that it includes a surface 22 (e.g., about two inches long) facing the secondary cutting edge 21 in order to enable blade-and-anvil cutting of an object positioned intermediate the secondary cutting edge 21 and the surface 22. Cutting occurs as the spine-opposing portion 19 of the conversion piece 12 and the spine 18 of the blade 13 move toward each other. Pivotal movement is about a pivotal axis of rotation 23 shown in FIG. 1 as depicted by the arrow A in FIG. 2.

For independent use of the knife 11 apart from the conversion piece 12, the user first manipulates a locking member 24 (FIGS. 4–7) on the handle portion 20 of the conversion piece 12. The locking member 24 is adapted to engage the handle 14 of the knife 11 in order to lock the convertible knife 10 in the close configuration illustrated in FIG. 1. The user manipulates the locking member 24 (i.e., pivots it) in order to disengage it from the handle 14 and thereby enable movement of the knife 11 and conversion piece 12 to the open configuration illustrated in FIG. 2. Then, the user withdraws the knife 11 from the conversion piece 12 so that the knife 11 can be used independent of the conversion piece 12 as suggested by FIG. 3. More specifically, he withdraws the knife 11 from a channel 25 (FIGS. 2 and 9) formed by a mid portion 26 of the conversion piece 12.

Figure 4:
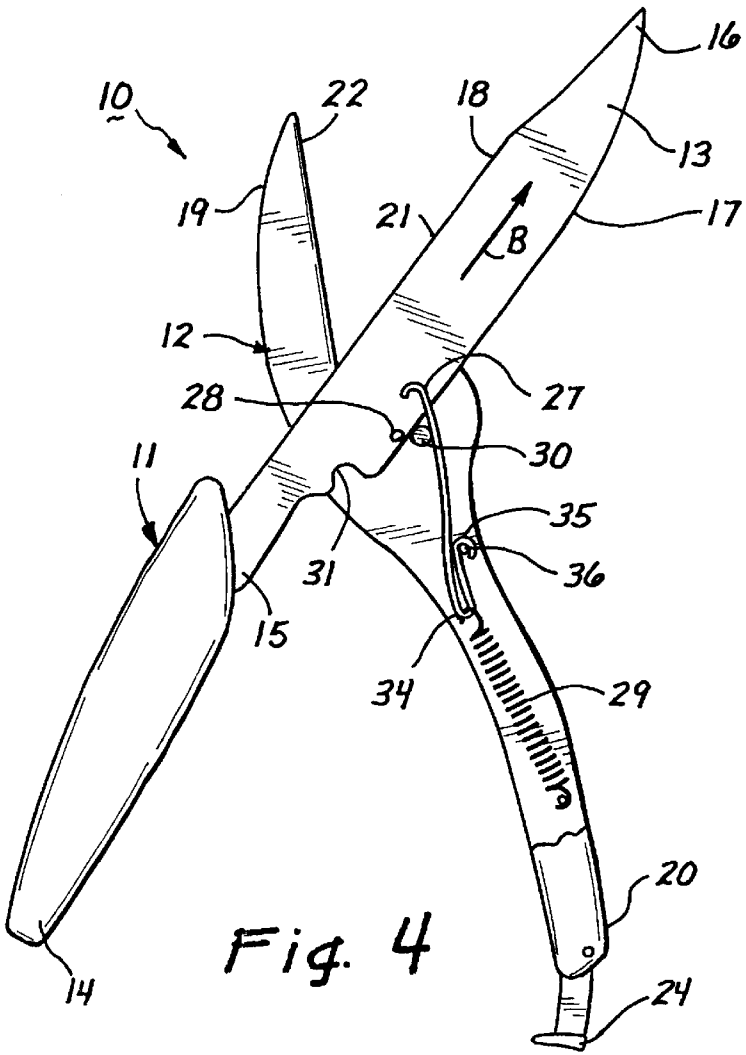
FIG. 4 is an enlarged plan view of the convertible knife showing an initial step in the procedure of assembling the knife and the conversion piece, with portions of the conversion piece broken away to expose the hook component and the spring component of the conversion piece.
Figure 7:
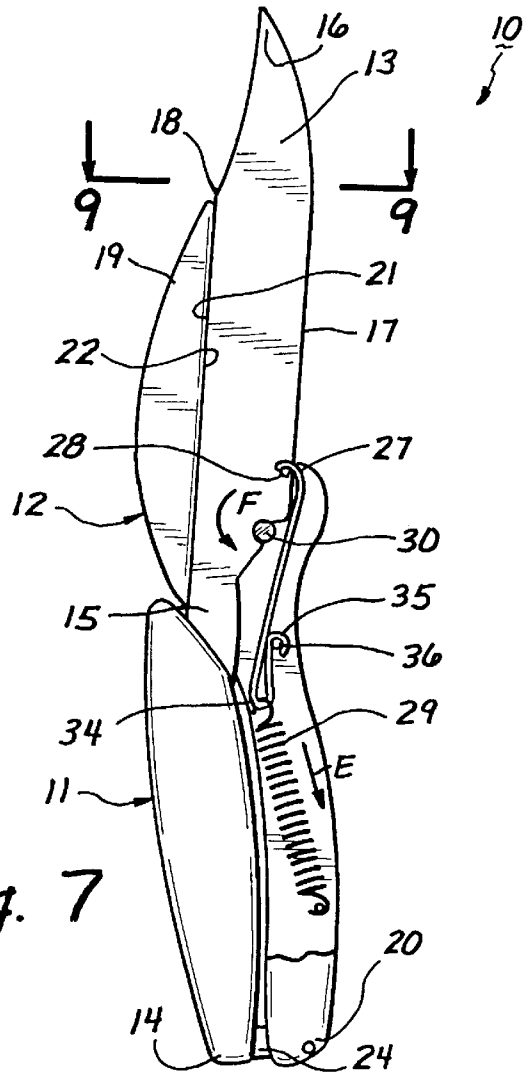
FIG. 7 is a plan view that shows the knife and the conversion piece completely assembled and in the closed configuration.
Figure 6:
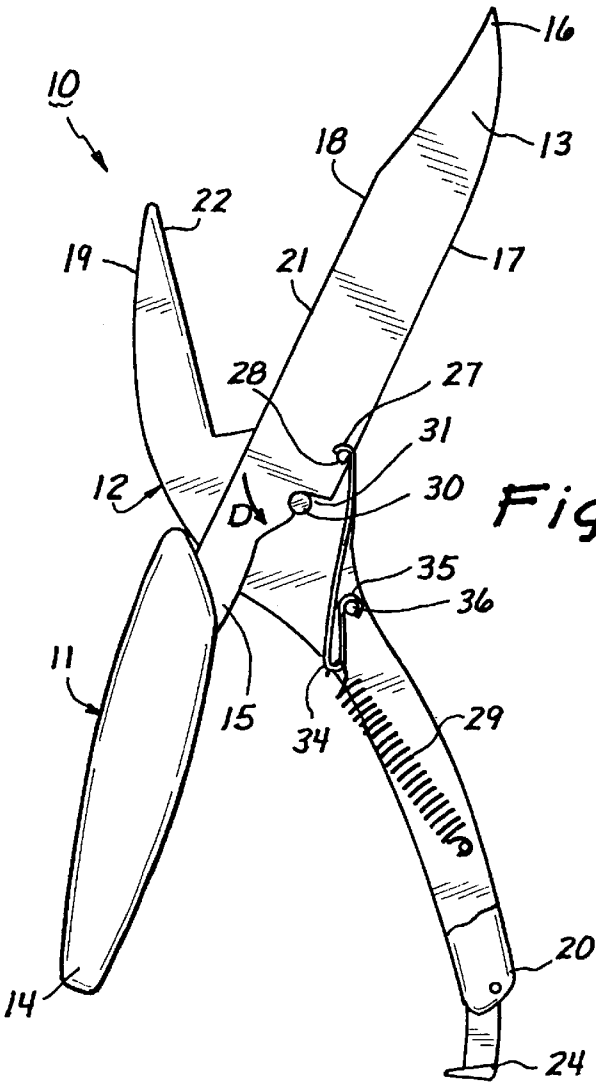
FIG. 6 is a plan view that shows the pivot pin on the conversion piece seating in the recess in the blade of the knife.

To reassemble the knife 11 and the conversion piece 12 back into the convertible knife 10, the user inserts the blade 13 of the knife 11 through the channel 25 as depicted by an arrow B in FIG. 4. As he continues to advance the blade 13 as depicted by an arrow C in FIG. 5, a hook member 27 on the conversion piece 12 engages a pin 28 protruding out of the blade 13. A spring 29 connected to the hook member 27 spring biases the hook member so that the hook member 27 pulls the blade 13 back toward a pivot pin 30 as depicted by an arrow D in FIG. 6. As that occurs, the pivot pin 30 seats in a recess 31 in the blade 13, where it is held by action of the hook-and-spring assembly formed by the hook member 27 and the spring 29, as depicted by an arrow E in FIG. 7. After that, the user pivots the knife 11 and conversion piece 12 to the closed configuration as depicted by an arrow F in FIG. 7, and then he manipulates the locking member 24 so that it engages the handle 14 and thereby locks the convertible knife 10 in the closed configuration.

Figure 8:
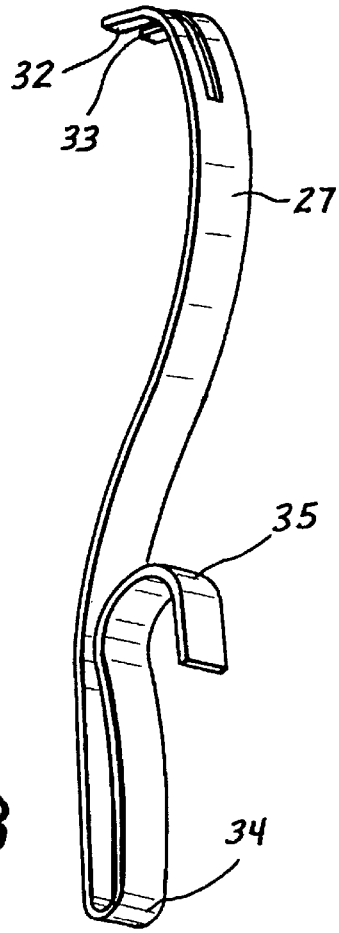
FIG. 8 is an enlarged view of the hook component.

FIG. 8 is an enlarged view of the hook component 27. It is a metal strip that includes spaced-apart, pin-engaging fingers 32 and 33 that fit on opposite sides of the blade 13 adjacent the pin 28. The spring 29 attaches to a spring-engaging portion 34 of the hook member 27, while a curved end 35 of the hook member 27 fits over a retaining pin 36 that is visible in FIGS. 4–7. Based upon the foregoing and subsequent descriptions, one of ordinary skill in the art can readily implement a convertible knife within the scope of the claims.

Figure 9:
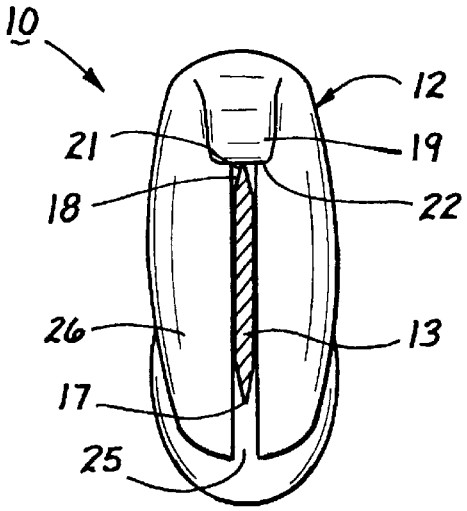
FIG. 9 is a cross sectional view of the convertible knife as viewed in a transverse plane containing a line 9—9 in FIG. 7.
Figure 9A:
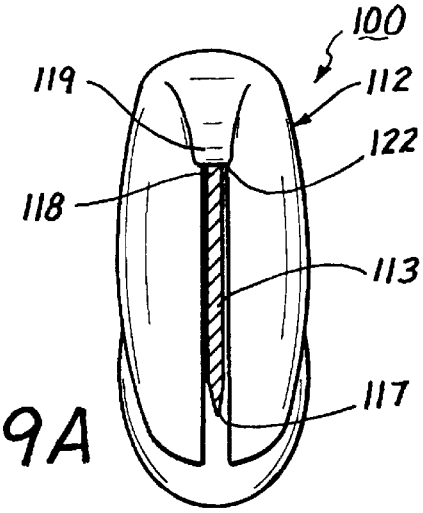
FIG. 9A is a cross sectional view of a second embodiment of the invention that is adapted for use as a crimping tool.

FIG. 9A shows another convertible knife 100 constructed according to the invention. It is similar in many respects to the convertible knife 10 and so only differences are described in further detail. For convenience, numerals designating parts of the convertible knife 100 are increased by one hundred over those designating corresponding or related parts of the convertible knife 10.

Similar to the convertible knife 10, the convertible knife 100 includes a conversion piece 112 having a spine-opposing portion 119 with a surface 122. It also includes a blade 113 with a cutting edge 117. However, the spine 118 of the blade 113 is not sharpened. That arrangement adapts the convertible knife 100 to use as a crimping tool. The spine-opposing portion 119 of the conversion piece 112 has a shape that forms a dull edge facing the spine of the blade (i.e., the surface 122) in order to enable crimping of an object. The user crimps the object between the spine 118 and the surface 122.

Figure 9B:
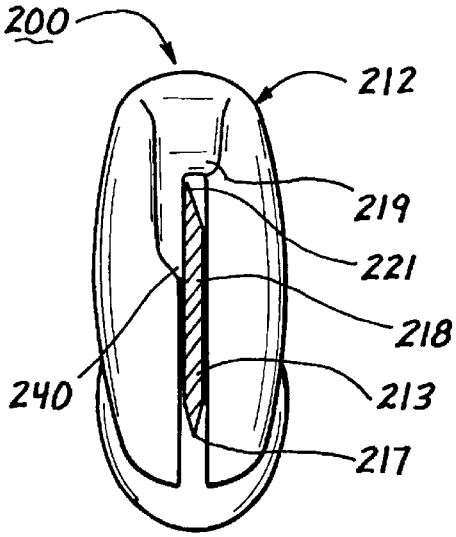
FIG. 9B is a cross sectional view of a third embodiment of the invention that is adapted for use as a shears.

FIG. 9B shows yet another convertible knife 200 constructed according to the invention. It is also similar in many respects to the convertible knife 10 and so only differences are described in further detail. For convenience, numerals designating parts of the convertible knife 200 are increased by two hundred over those designating corresponding or related parts of the convertible knife 10.

Similar to the convertible knife 10, the convertible knife 200 includes a conversion piece 212 having a spine-opposing portion 219. It also includes a blade 213 having a cutting edge 217 and a sharpened spine 218 that forms a secondary cutting edge 221. Unlike the convertible knife 10, however, the spine-opposing portion 219 of the conversion piece 212 does not form an anvil. Instead, the spine-opposing portion 219 has a shape that forms a conversion piece cutting edge 240 opposing the secondary cutting edge 221 of the blade 213 in order to enable shears-type cutting of an object. The user cuts the object by shears action of the conversion piece cutting edge 240 and the secondary cutting edge 221 of the blade 213.

Figure 10:
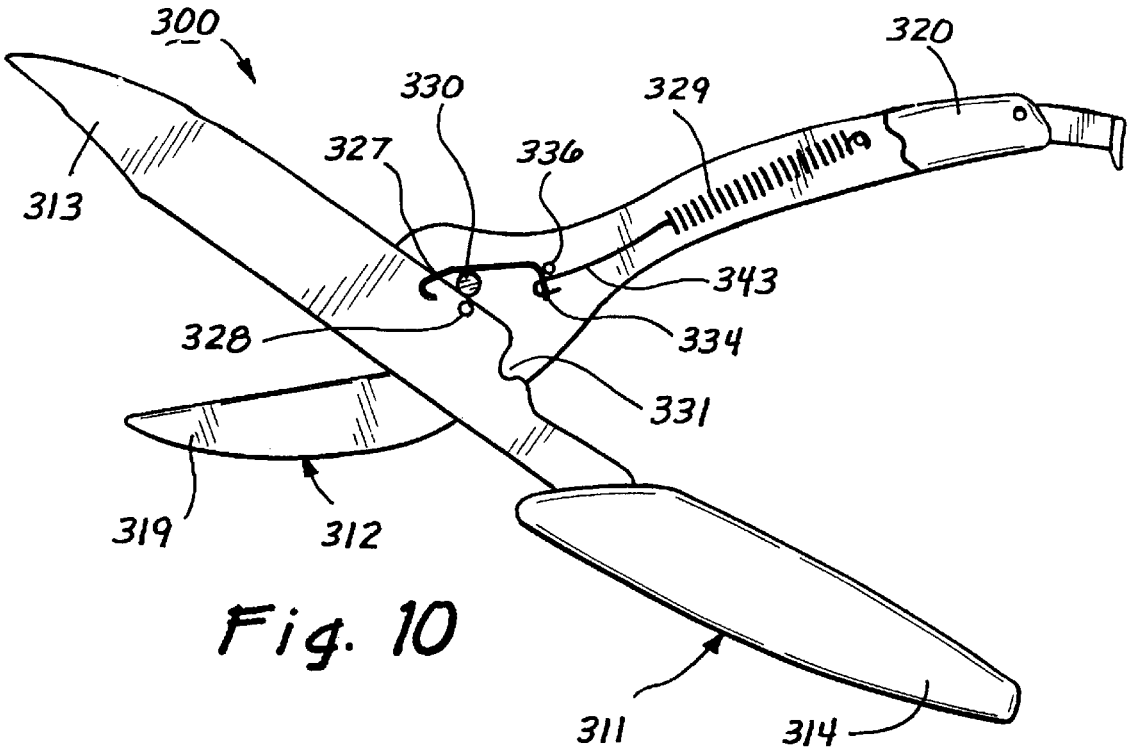
FIG. 10 is a plan view (similar to FIG. 4) of a fourth embodiment of the invention having a different second hook component and different second spring component that form a different hook-and-spring assembly.
Figure 11:
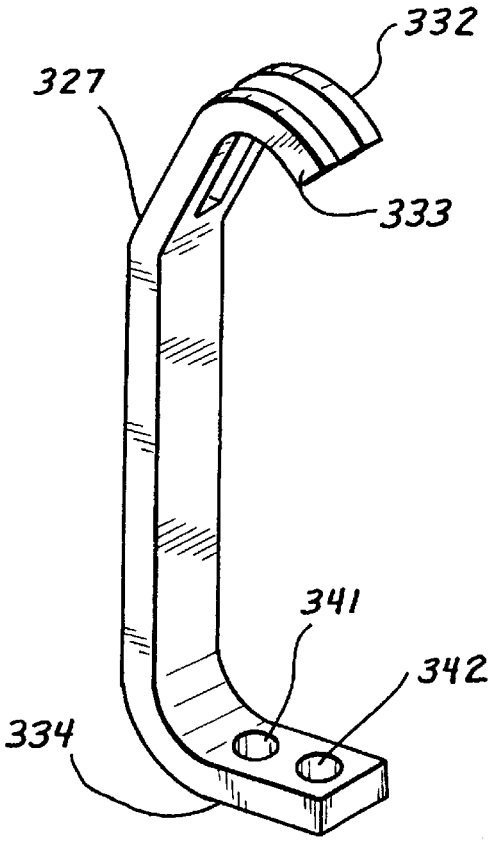
FIG. 11 is an enlarged view (similar to FIG. 8) of just the second hook component.

Turning now to FIGS. 10 and 11, they show a convertible knife 300 constructed according to the invention that includes a different hook member. The convertible knife 300 is otherwise similar in many respects to the convertible knife 10 and so only differences are described in further detail. For convenience, numerals designating parts of the convertible knife 300 are increased by three hundred over those designating corresponding or related parts of the convertible knife 10.

Similar to the convertible knife 10, the convertible knife 300 includes a knife 311 having a blade 313 and a handle 314. It also includes a conversion piece 312 having a spine-opposing portion 319 and a handle portion 320. Those two components assemble together to form the convertible knife 300. A hook member 327 and a spring 329 combine to form a hook-and-spring assembly that engages a pin 328 on the blade 313 to hold a pivot pin 330 within a recess 331 in the blade 313. Instead of a curved end of the hook member engaging a retaining pin 336 in the manner of the curved end 35 of the hook member 27, the spring-engaging portion 334 of the hook member 327 is L-shaped and provided with two holes 341 and 342 (FIG. 11) for receiving a U-shaped end portion 343 of the spring 329 (FIG. 10), so that the spring-engaging portion 334 rests against the retaining pin 336 as illustrated in FIG. 10. The U-shaped end portion 343 slides against the retaining pin 336 during assembly and disassembly of the convertible knife 300. This arrangement facilitates fabrication and operation of the conversion piece 312.

Thus, the invention provides a convertible knife that the user can readily disassembly for independent use of the knife and for cleaning purposes. Although an exemplary embodiments have been shown and described, one of ordinary skill in the art may make many changes, modifications, and substitutions without necessarily departing from the spirit and scope of the invention.

What is claimed is:

1. A convertible knife assembly, comprising:

a knife having a handle and a blade, which blade includes a proximal end portion attached to the handle, a distal end portion, a cutting edge intermediate the proximal and distal end portions, and a spine intermediate the proximal and distal end portions that is disposed opposite the cutting edge; and a conversion piece having a spine-opposing portion and a handle portion, which conversion piece is adapted to be mounted on the knife pivotally with the spine-opposing portion opposing the spine of the blade and the handle portion opposing the handle of the knife so that the action of a user squeezing the handle portion of the conversion piece and handle of the knife toward each other causes the spine-opposing portion of the conversion piece and the spine of the blade to move toward each other in order to bear against an object the user positions between the spine-opposing portion of the conversion piece and the spine of the blade, said cutting edge of said blade being spaced from said spine-opposing portion by the width of said blade;

wherein the spine-opposing portion of the conversion piece has a shape that forms a dull edge facing the spine of the blade in order to enable crimping of an object.

2. A convertible knife assembly, comprising:

a knife having a handle and a blade, which blade includes a proximal end portion attached to the handle, a distal end portion, a cutting edge intermediate the proximal and distal end portions, and a spine intermediate the proximal and distal end portions that is disposed opposite the cutting edge; and a conversion piece having a spine-opposing portion and a handle portion, which conversion piece is adapted to be mounted on the knife pivotally with the spine-opposing portion opposing the spine of the blade and the handle portion opposing the handle of the knife so that the action of a user squeezing the handle portion of the conversion piece and handle of the knife toward each other causes the spine-opposing portion of the conversion piece and the spine of the blade to move toward each other in order to bear against an object the user positions between the spine-opposing portion of the conversion piece and the spine of the blade, said cutting edge of said blade being spaced from said spine-opposing portion by the width of said blade;

wherein the conversion piece includes a mid portion that defines a channel into which the blade of the knife fits;

wherein the mid portion of the conversion piece includes a pin extending across the channel that defines a pivot point;

wherein the blade of the knife defines a recess adapted to engage the pin;

wherein the blade includes a protrusion proximate the recess; and wherein the conversion piece includes a spring loaded hook assembly adapted to engage the protrusion as the blade is inserted into the channel and to spring bias the blade toward the pin as the pin seats in the recess.

3. A convertible knife assembly as recited in claim 2, wherein the spine of the blade includes a sharpened portion that forms a secondary cutting edge.

4. A convertible knife assembly as recited in claim 3, wherein the spine-opposing portion of the conversion piece has a shape that forms an anvil facing the secondary cutting edge in order to thereby enable blade-and-anvil cutting of the object.

5. A convertible knife assembly as recited in claim 3, wherein the spine-opposing portion of the conversion piece has a shape that forms a conversion piece cutting edge opposing the secondary cutting edge of the blade in order to enable shears-type cutting of the object.

* * * * *